US008702196B2

(12) United States Patent
Yoshida

(10) Patent No.: US 8,702,196 B2
(45) Date of Patent: Apr. 22, 2014

(54) PRINTING DEVICE FOR CONTROLLING MOVEMENT OF CARRIAGE

(75) Inventor: Yuji Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 13/303,833

(22) Filed: Nov. 23, 2011

(65) Prior Publication Data

US 2012/0127232 A1 May 24, 2012

(30) Foreign Application Priority Data

Nov. 24, 2010 (JP) ..... 2010-260939

(51) Int. Cl.
*B41J 29/393* (2006.01)

(52) U.S. Cl.
USPC ..... 347/19; 347/14; 347/17

(58) Field of Classification Search
USPC ..... 347/9, 14, 17–19, 20, 84–87, 108
See application file for complete search history.

(56) References Cited

U.S. PATENT DOCUMENTS

| | | | | |
|---|---|---|---|---|
| 6,530,634 | B1 * | 3/2003 | Hara | 347/7 |
| 7,431,521 | B2 * | 10/2008 | Kakegawa | 400/319 |
| 2008/0123263 | A1 | 5/2008 | Ueda | |
| 2009/0219695 | A1 | 9/2009 | Tomioka | |

FOREIGN PATENT DOCUMENTS

| | | | |
|---|---|---|---|
| JP | 10-290550 | A | 10/1998 |
| JP | 2008-135552 | A | 6/2008 |
| JP | 2008-197461 | A | 8/2008 |
| JP | 2008-277712 | A | 11/2008 |
| JP | 2009-204254 | A | 9/2009 |
| JP | 2010-148024 | A | 7/2010 |

* cited by examiner

*Primary Examiner* — Juanita D Jackson
(74) *Attorney, Agent, or Firm* — Global IP Counselors, LLP

(57) ABSTRACT

A printing device includes a casing having an opening, a carriage provided to be capable of moving within the casing, a heat-generating part provided inside the casing so as to be positioned deeper in from the opening than the carriage, and a detecting part for detecting the temperature of the interior of the casing; wherein when the detected temperature of the detecting part exceeds a predetermined value, the carriage is stopped at a position covering at least part of the heat-generating part as seen through the opening.

13 Claims, 7 Drawing Sheets

PRINTING DEVICE FOR CONTROLLING MOVEMENT OF CARRIAGE

CROSS-REFERENCE TO RELATED APPLICATIONS

This application claims priority to Japanese Patent Application No. 2010-260939 filed on Nov. 24, 2010. The entire disclosure of Japanese Patent Application No. 2010-260939 is hereby incorporated herein by reference.

BACKGROUND

1. Technical Field

The present invention relates to a printing device.

2. Background Technology

One known example of a printing device is an inkjet printer which ejects ink from a head mounted on a carriage to perform printing. This type of printer uses a heat-generating member which generates heat during driving. For example, a drive signal generating circuit, which generates a drive signal for driving a drive element of the head, has an electric current amplifying circuit composed of a pair of transistors, and these transistors generate heat when a drive signal is generated. Printers use various different motors, and heat is similarly generated in motor drivers for driving the motors. In view of this, there have been proposals of a printer which includes a heat-radiating member for radiating the heat generated by the transistors or other heat-generating members (also referred to as heat-generating parts hereinbelow) (see Patent Citation 1, for example).

Japanese Patent Application Publication No. 2008-197461 (Patent Citation 1) is examples of the related art.

SUMMARY

Problems to Be Solved by the Invention

To optimize space, it is possible for the heat-radiating member to be disposed in a location where it can be touched by the user. For example, the heat-radiating member is provided exposed in an internal space which is opened up by opening a cover of the printer. In this case, if the heat-generating part reaches an abnormal temperature (a high temperature), the heat-radiating member could reach a high temperature as well, and there is a risk of the user touching the high-temperature portion of the heat-radiating member.

In view of this, an advantage of the invention is to improve safety.

Means Used to Solve the Above-Mentioned Problems

A primary aspect for achieving the advantage described above is a printing device including a casing having an opening, a carriage provided to be capable of moving within the casing in a predetermined direction, a heat-generating part provided inside the casing so as to be positioned deeper in from the opening than the carriage, and a detecting part for detecting the temperature of the interior of the casing including the heat-generating part; wherein when the detected temperature of the detecting part exceeds a predetermined value, the carriage is stopped at a position covering at least part of the heat-generating part as seen through the opening.

Other characteristics of the invention are made clear from the present specification and the descriptions of the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
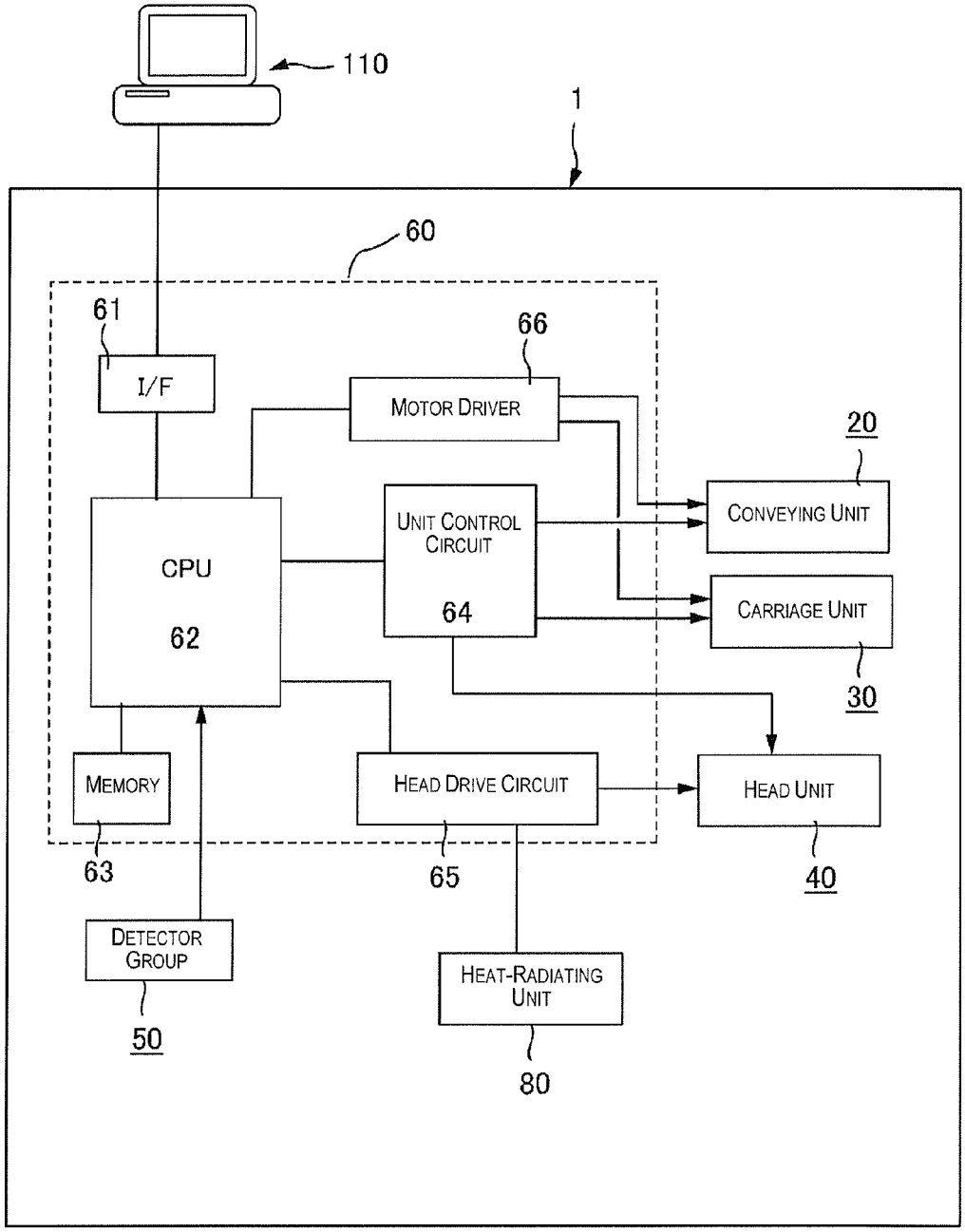
FIG. 1 is a block diagram showing the overall configuration of a printer 1.

At least the following matters are made clear from the present specification and the descriptions of the accompanying drawings.

What is made clear is a printing device including a casing having an opening, a carriage provided to be capable of moving in a predetermined direction within the casing, a heat-generating part provided inside the casing so as to be positioned deeper in from the opening than the carriage, and a detecting part for detecting the temperature inside the casing including the heat-generating part; wherein when the detected temperature of the detecting part exceeds a predetermined value, the carriage is stopped at a position covering at least part of the heat-generating part as seen through the opening. According to such a printing device, safety can be improved.

What is also made clear is a printing device including a casing having an opening, a carriage provided to be capable of moving in a predetermined direction within the casing, a heat-generating part provided inside the casing so as to be positioned deeper in from the opening than the carriage, and a detecting part for detecting the temperature inside the casing including the heat-generating part; wherein when the detected temperature of the detecting part exceeds a predetermined value, the carriage is stopped at a position covering at least part of the opening as seen through the opening.

What is also made clear is a printing device including a casing having an opening, a carriage provided to be capable of moving in a predetermined direction within the casing, a heat-generating part provided inside the casing so as to be positioned deeper in from the opening than the carriage, and a detecting part for detecting the temperature inside the casing including the heat-generating part; wherein when the detected temperature of the detecting part exceeds a predetermined value, the carriage is stopped so that at least part of the carriage is positioned between the heat-generating part and the opening.

Preferably, in this printing device, a head for discharging ink is mounted on the carriage, and when the detected temperature of the detecting part exceeds a predetermined value, the carriage is stopped after the carriage is moved without discharging ink from the head. According to such a printing device, safety can be further improved because the driving of the heat-generating part can be promptly stopped.

Preferably, in this printing device, the heat-generating part has a head drive transistor for driving the head and a paper-feeding motor drive transistor for driving a paper-feeding motor, the detecting part is provided both to the proximity of the head drive transistor and the proximity of the paper-feeding motor drive transistor, and when the detected temperature of the former detecting part exceeds the predetermined value and the detected temperature of the latter detecting part has not reached the predetermined value, paper on which the head had printed is ejected and a power source is turned off. According to such a printing device, safety can be improved.

Preferably, in this printing device, a cover is provided to the casing so as to close off the opening, and when the cover is open and the detected temperature of the detecting part exceeds the predetermined value, the carriage is stopped at a predetermined position. According to such a printing device, safety is maintained and the carriage need not be moved uselessly.

In the following embodiments, the description proceeds using an inkjet printer as a printing device.

Basic Configuration of Printing Device

Configuration of Printer

Figure 2A:
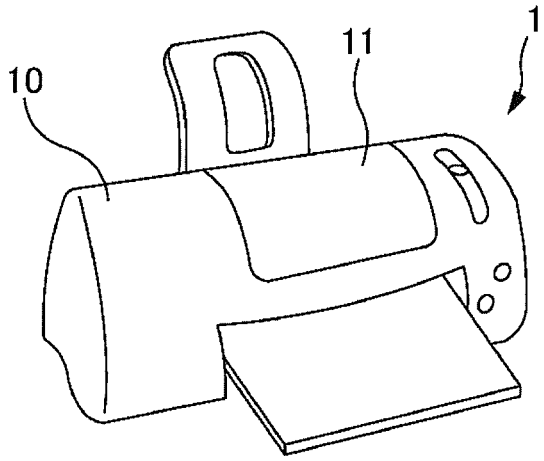
FIGS. 2A and 2B are external views of the printer 1.
Figure 2B:
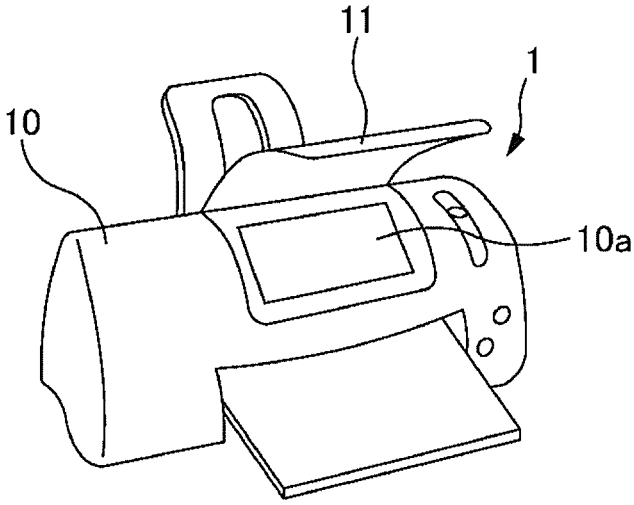
Figure 3A:
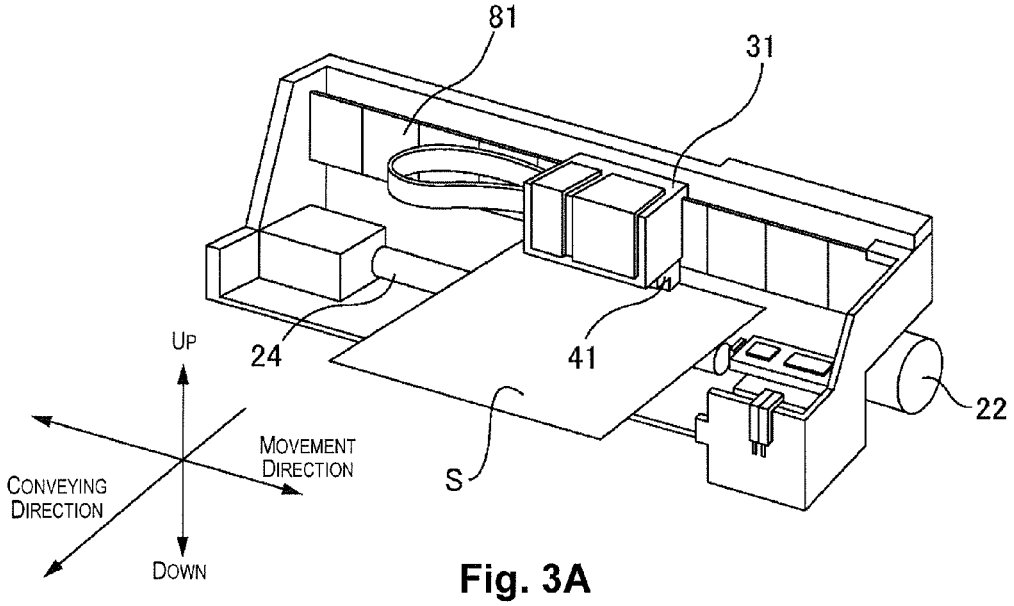
FIGS. 3A and 3B are drawings showing the internal configuration of the printer 1 of the present embodiment.
Figure 3B:
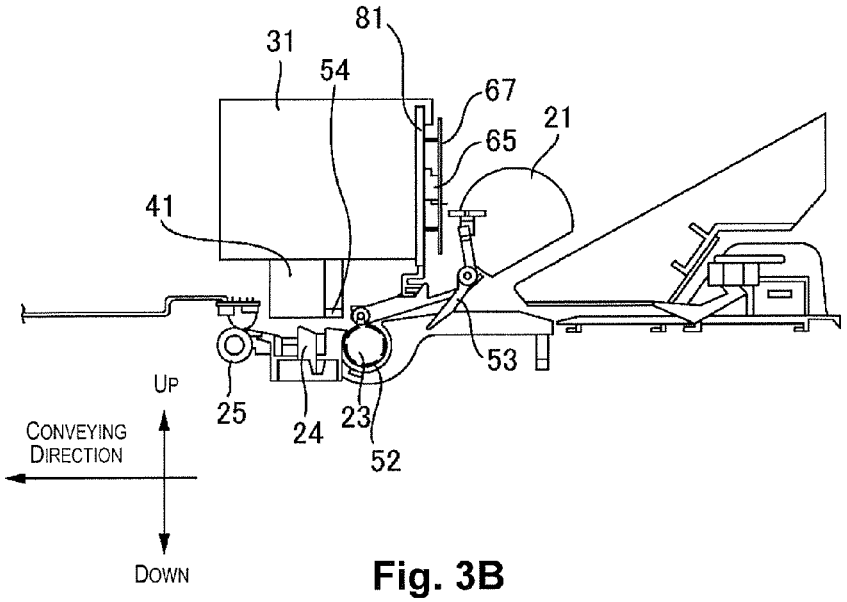

FIG. 1 is a block diagram showing the overall configuration of a printer 1. FIGS. 2A and 2B are external views of the printer 1. FIGS. 3A and 3B are drawings showing the internal configuration of the printer 1 of the present embodiment.

The printer 1 is an inkjet printer which records (prints) characters or images by ejecting ink onto paper, cloth, film, or another medium, and the printer is communicably connected with a computer 110 as an external device.

A printer driver is installed in the computer 110. The printer driver is a program for displaying a user interface on a display device (not shown), and converting image data outputted from an application program into print data. This printer driver is recorded on a flexible disk FD, a CD-ROM, or another recording medium (a recording medium that can be read by a computer). The printer driver is also capable of downloading onto the computer 110 via the internet. This program is made of codes for implementing various functions.

The computer 110 outputs print data corresponding to an image to be printed to the printer 1 in order to cause the printer 1 to print the image.

The printer 1 has a casing 10 and a cover 11, as shown in FIGS. 2A and 2B.

The casing 10 is for accommodating the other units (described hereinafter) of the printer 1 in the interior. The casing 10 is provided with an opening 10*a* as shown in FIG. 2B. When the cover 11 is in a closed state (FIG. 2A), the opening 10*a* is closed off by the cover 11, and when the cover 11 is in an open state (FIG. 2B), the opening 10*a* is exposed.

The cover 11 is provided to the casing 10 so as to be capable of being opened and closed, and the internal space of the printer 1 can be opened up via the opening 10*a* by opening the cover 11 (putting it into its open state).

The details of the other units provided to the interior of the printer 1 are described hereinbelow.

The printer 1 has a conveying unit 20, a carriage unit 30, a head unit 40, a detector group 50, a controller 60, and a heat-radiating unit 80. The controller 60 controls the other units on the basis of the print data received from the computer 110 as an external device, and prints an image on a medium. The conditions inside the printer 1 are observed by the detector group 50, and the detector group 50 outputs detection results to the controller 60. The controller 60 controls the other units on the basis of the detection results outputted from the detector group 50.

Conveying Unit 20

The conveying unit 20 is for conveying the medium (e.g. paper S or the like) in a predetermined direction (referred to as the conveying direction hereinbelow). The conveying direction is a direction which intersects the direction in which a hereinafter-described carriage 31 moves (referred to as the movement direction hereinbelow). The conveying unit 20 has a paper-feeding roller 21, a conveying motor 22, a conveying roller 23, a platen 24, and a paper-ejecting roller 25 (FIGS. 3A and 3B).

The paper-feeding roller 21 is for feeding paper inserted through a paper insertion hole into the printer. The conveying roller 23 is a roller which conveys paper S fed by the paper-feeding roller 21 to a printable area, and is driven by the conveying motor 22. The action of the conveying motor 22 is controlled by the controller 60 on the printer side. The platen 24 is a member which supports paper S during printing from the rear side of the paper S. The paper-ejecting roller 25 is a roller which ejects the paper S out of the printer, and is provided downstream in the conveying direction from the printable area.

The conveying motor 22 generates heat by driving (rotating) when conveying the medium. A gear train (not shown), which is provided in order to transmit the drive force of the conveying motor 22 to the conveying roller, also generates heat by friction when rotating. In other words, the conveying motor 22 and the gear train can be said to be heat-generating parts of the printer 1.

Carriage Unit 30

The carriage unit 30 is for moving (also called "scanning") the carriage 31 to which the head unit 40 is attached in the movement direction. The carriage unit 30 has a carriage 31 and a carriage motor (not shown) (FIGS. 3A and 3B).

The carriage 31 is capable of moving back and forth in the movement direction, and is driven by the carriage motor. The action of the carriage motor is controlled by the controller 60 on the printer side. The carriage 31 also holds a detachable ink cartridge which accommodates ink.

The carriage 31 is provided upstream in the conveying direction from the aforementioned opening 10*a*. When ink is being replaced, the user can touch the carriage 31 via the opening 10*a* by opening the cover 11.

The carriage motor and the gear train (not shown) for moving the carriage 31 using the drive force of the carriage motor generate heat during the action of moving the carriage 31. In other words, the carriage motor and the gear train can be said to be heat-generating parts of the printer 1.

Head Unit 40

The head unit 40 is for ejecting ink onto the paper S. The head unit 40 includes a head 41 having a plurality of nozzles. This head 41 is provided to the carriage 31, and when the carriage 31 moves in the movement direction, the head 41 also moves in the movement direction. The head 41 ejects ink intermittently while moving in the movement direction, whereby dot lines (raster lines) are formed on the paper along the movement direction.

Figure 4:
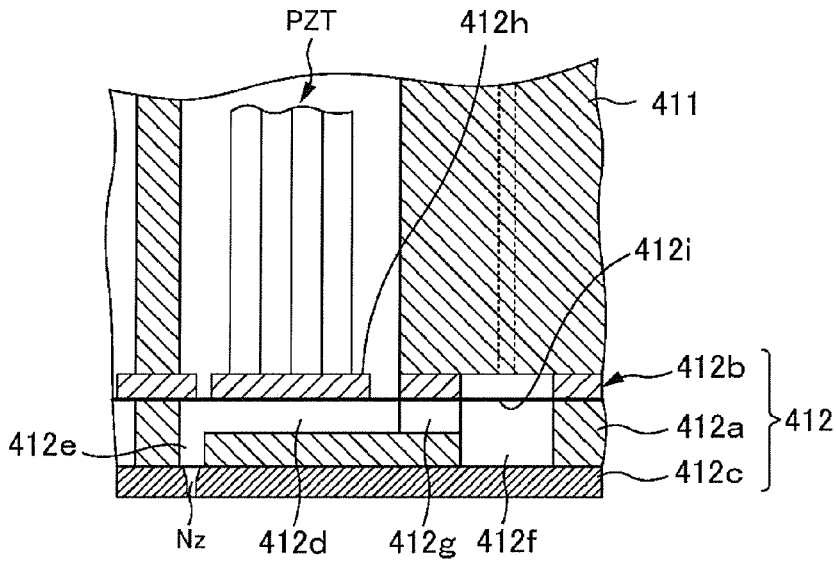
FIG. 4 is a cross-sectional view showing a structure of a head 41.

FIG. 4 is a cross-sectional view showing an example of the structure of the head 41. The head 41 has a case 411, a flow passage unit 412, and a piezo element group PZT. The case 411 houses the piezo element group PZT, and the flow passage unit 412 is bonded to the bottom surface of the case 411. The flow passage unit 412 has a flow passage formation plate 412*a*, an elastic plate 412*b*, and a nozzle plate 412*c*. Formed in the flow passage formation plate 412*a* are a groove which acts as a pressure chamber 412*d*, a through-hole which acts as a nozzle communication hole 412*e*, a through-hole which acts as a shared ink chamber 412*f*, and a groove which acts as an ink supply passage 412*g*. The elastic plate 412*b* has an island part 412*h* to which the distal end of the piezo element group PZT is bonded. An area made elastic by an elastic film 412*i* is formed around the periphery of the island part 412*h*. Ink stored in the ink cartridge is supplied via the shared ink chamber 412*f* to pressure chambers 412*d* corresponding to respective nozzles Nz. The nozzle plate 412*c* is a plate in which the nozzles Nz are formed. Formed in each nozzle surface are a yellow nozzle row Y for discharging yellow ink, a magenta nozzle row M for discharging magenta ink, a cyan nozzle row C for discharging cyan ink, and a black nozzle row K for discharging black ink. The nozzle rows are configured by nozzles Nz aligned at predetermined intervals D in the conveying direction.

The piezo element group PZT has a plurality of pectinate piezo elements (drive elements), and a number of these groups proportionate to the nozzles Nz are provided. Drive signals COM is applied to the piezo elements via a wiring substrate (not shown) equipped with a head drive part HC or the like, and the piezo elements expand and contract vertically according to the electric potential of the drive signals COM. When the piezo element PZT expands and contracts, the island part 412*h* is pressed into the pressure chamber 412*d* or pulled in the opposite direction. At this time, the elastic film 412*i* surrounding the island part 412*h* deforms and the pressure inside the pressure chamber 412*d* rises or falls, whereby ink droplets are discharged from the nozzle.

Detector Group 50

The detector group 50 is for observing the conditions of the printer 1. The detector group 50 includes a linear encoder 51, a rotary encoder 52, a paper detection sensor 53, an optical sensor 54, and other components (FIGS. 3A and 3B).

The linear encoder 51 detects the position of the carriage 31 in the movement direction. The rotary encoder 52 detects the rotating rate of the conveying roller 23. The paper detection sensor 53 detects the position of the distal end of the paper S being fed. The optical sensor 54 can detect whether or not a paper S is in an opposing position by a light-emitting part and a light-receiving part attached to the carriage 31, detect the position of the end of the paper while moving, for example, and detect the width of the paper. Depending on the conditions, the optical sensor 54 is also capable of detecting the distal end (the end on the downstream side in the conveying direction, also referred to as the top end) and rear end (the end on the upstream side in the conveying direction, also referred to as the bottom end) of the paper S.

In the present embodiment, temperature sensors (e.g. thermistors) for detecting the temperatures of heat-generating parts described hereinafter are provided as the detector group 50.

Controller 60

The controller 60 is a control unit (a control part) for performing control on the printer. The controller 60 has an interface 61, a CPU 62, a memory 63, a unit control circuit 64, a head drive circuit 65, and a motor driver 66.

The interface 61 performs the transmission of data between the computer 110 as an external device and the printer 1. The CPU 62 is a computing and processing device for performing control on the entire printer 1. The memory 63 is for ensuring areas for storing the programs of the CPU 62, operating areas, and the like, and is configured from RAM, EEPROM, and other storage elements. The CPU 62 controls the conveying unit 20 and other units via the unit control circuit 64 in accordance with the programs stored in the memory 63.

The head drive circuit 65 performs the exchange of head driving related information between the CPU 62 and the head unit 40, such as the transfer of data for printing and the control of print timing. The head drive circuit 65 also generates a drive signal COM (a drive waveform) for driving the piezo element PZT. When the drive signal COM is generated, an electric current waveform is amplified using an amplifier having an NPN transistor and a PNP transistor (neither are shown) in a push-pull configuration, and a trapezoid wave of the desired shape is generated. This trapezoid wave is applied to the head unit 40 to perform electrical charge and discharge in the piezo element PZT. During electrical charge and discharge of the piezo element PZT, the pair of transistors generates extremely high heat, and the head drive circuit 65 can therefore be said to be a heat-generating part of the printer 1. The head drive circuit 65 is provided on the top of a printed circuit board 67. The printed circuit board 67 is fixed to the heat-radiating member 81, described hereinafter, so as to sandwich the head drive circuit 65 (FIG. 2B).

The motor driver 66 controls the rotational direction, rotational speed, and other characteristics of the conveying motor 22 and the carriage motor (not shown). A transistor and an FET (not shown) are incorporated in the motor driver 66, and when the various motors are driven, a bridge circuit configured by the transistor and other components is used to amplify the electric current. The transistor generates extremely high heat at this time, and the motor driver 66 therefore can also be said to be a heat-generating part of the printer 1.

Heat-Radiating Unit 80

The heat-radiating unit 80 is a heat-radiating device for radiating into the surrounding atmosphere the heat generated by the previously described head drive circuit 65, motor driver 66, and other heat-generating parts. The description hereinbelow is of a case in which the heat-radiating unit 80 is provided to the head drive circuit 65, which has the highest temperature during the printing action out of the previously described plurality of heat-generating parts. A heat-radiating unit 80 can be provided to each of the previously described plurality of heat-generating parts, the heat-generating parts can be designed so as to be disposed as close to each other as possible, or only one heat-radiating unit 80 shared by all the heat-generating parts need be provided. The heat-radiating unit 80 has a heat-radiating member 81.

The heat-radiating member 81 is a metal plate made of aluminum or iron. The heat-radiating member 81 releases heat generated by a heat-generating part by radiating it into the surrounding atmosphere from the surface of the heat-radiating member 81, and the heat-generating part is cooled. The larger its contact surface area with the atmosphere, the more readily the heat-radiating member 81 radiates heat. In other words, the larger the surface area, the higher the cooling performance. In the present embodiment, the heat-radiating member 81 has a rectangular plate shape extending in the carriage movement direction as shown in FIGS. 3A and 3B, whereby the surface area is made as wide as possible.

The heat-radiating member 81 of the present embodiment is also a rail for the carriage 31 as shown in FIGS. 3A and 3B. The carriage 31 moves in the movement direction while guided by the heat-radiating member 81 extending in the movement direction. On the surface (the surface upstream in the conveying direction) of the heat-radiating member 81 opposite the surface (the surface downstream in the conveying direction) facing the carriage 31, the printed circuit board 67 is fixed so as to sandwich the head drive circuit 65. In other words, seen through the opening 10*a*, the head drive circuit 65 as a heat-generating part is disposed deeper in than the carriage 31.

Printing Action of Printer

The printing action of the printer 1 is described in a simple manner. The controller 60 receives a print command from the computer 110 via the interface 61, and by controlling the other units, the controller 60 performs a paper-feeding process, a dot-forming process, a conveying process, and other processes.

The paper-feeding process is a process whereby paper for printing is supplied into the printer, and the paper is positioned in a print starting position (also referred to as a cueing position). The controller 60 rotates the paper-feeding roller 21 and feeds the paper for printing to the conveying roller 23. The conveying roller 23 is then rotated and the paper fed from the paper-feeding roller 21 is positioned in the print starting position.

The dot-forming process is a process whereby ink is intermittently ejected from the head moving along the movement direction (scanning direction), and dots are formed on the paper. The controller 60 causes the carriage 31 to move in the movement direction and causes ink to be ejected from the head 41 on the basis of the print data while the carriage 31 is moving. When the ejected ink droplets are deposited on the paper, dots are formed on the paper, and a dot line composed of a plurality of dots in the movement direction is formed on the paper.

The conveying process is a process whereby the paper is conveyed in the conveying direction relative to the head. The controller 60 rotates the conveying roller 23 to convey the paper in the conveying direction. Through this conveying process, the head 41 can form dots in different positions than those of the dots formed by the previous dot-forming process.

The controller 60 alternately repeats the dot-forming process and the conveying process until there is no more data to be printed, and gradually prints an image composed of dot lines on the paper. When there is no more data to be printed, the paper-ejecting roller is rotated to eject the paper. The determination of whether or not to eject the paper can be based on a paper ejection command included in the print data.

If printing is to be performed on a next paper, the same process is repeated, otherwise the printing action is ended.

Heat Radiation

Figure 5:
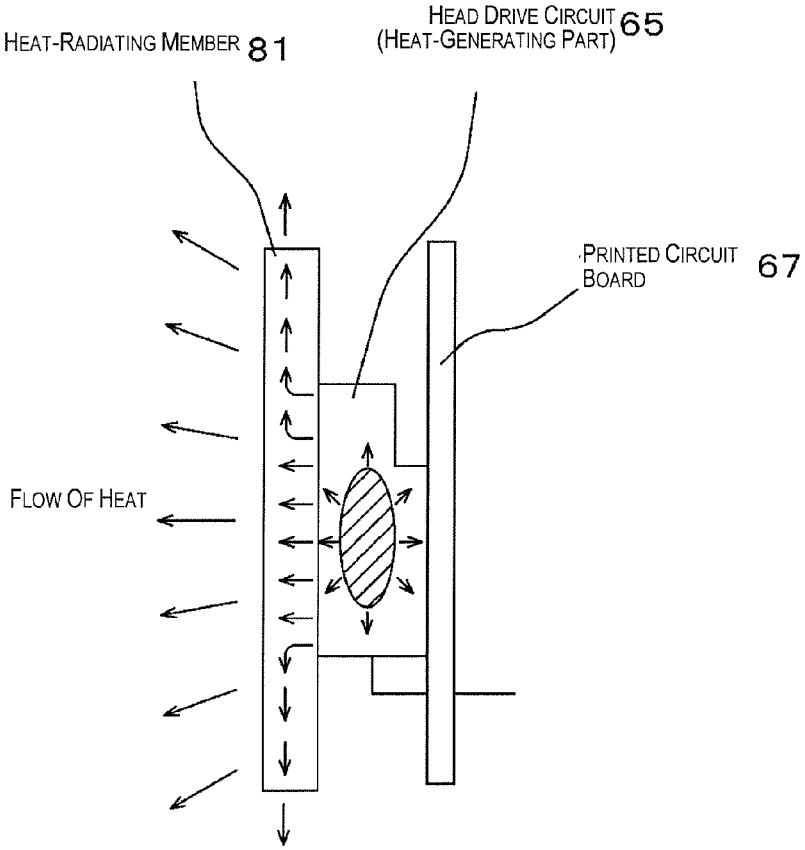
FIG. 5 is a drawing for describing the manner in which heat is radiated.

FIG. 5 is a drawing for describing the manner in which heat is radiated by the heat-radiating member 81. In this drawing the head drive circuit 65 (a heat-generating part) is provided on the top of the printed circuit board 67, and the heat-radiating member 81 is provided in contact with the head drive circuit 65. The arrows in the drawing show the flow of heat during heat radiation.

The heat generated by the heat-generating part (in this case, the head drive circuit 65) is released in four directions centered around a heat source (a transistor or the like) shown by the diagonal lines in the drawing. Although the head drive circuit 65 is in contact with the printed circuit board 67 and the heat-radiating member 81, the generated heat moves primarily toward the heat-radiating member 81 because the printed circuit board 67 has poor heat conductivity. Since the heat-radiating member 81 has a lower temperature and higher heat conductivity than the heat-generating part, the heat generated by the heat-generating part (the head drive circuit 65) is conducted into the heat-radiating member 81 from the area where the head drive circuit 65 and the heat-radiating member 81 are in contact, then further conducted through the heat-radiating member 81 and radiated from the surface on the opposite side out to the atmosphere. The heat-generating part (the head drive circuit 65) is thereby cooled. The portion of the heat-radiating member 81 that is in contact with the heat-generating part has the highest temperature, and the farther away from the heat-generating part, the lower the temperature. This is because heat is radiated into the atmosphere by the process of conducting heat through the heat-radiating member 81.

During printing, the heat generated by the head drive circuit 65 sometimes reaches an abnormally high temperature (e.g. 70 degrees). Therefore, it is preferable to dispose the heat-radiating member 81 in a position where it cannot be touched by the user, but disposing the heat-radiating member 81 in a position where it can be touched by the user is sometimes unavoidable in terms of convenience in the device's design. In the present embodiment, when the cover 11 is opened, the heat-radiating member 81 can be touched via the opening 10*a* of the casing 10. In this case, when some abnormality arises in the head drive circuit 65 and the amount of heat generated increases, there is a danger that the temperature of the heat-radiating member 81 (particularly the portion in contact with the head drive circuit 65) could increase.

In view of this, the embodiment described hereinbelow is intended to improve safety when a temperature of the head drive circuit 65 (the heat-generating part) becomes abnormal.

First Embodiment

Comparative Example

Before the present embodiment is described, a comparative example will first be described.

Figure 6:
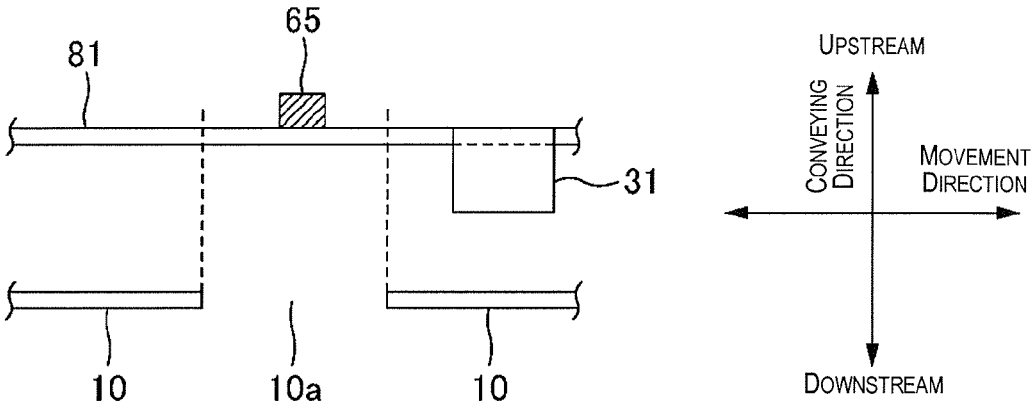
FIG. 6 is a simplified explanatory drawing of the stopping position of the carriage in a comparative example.

FIG. 6 is a simplified explanatory drawing of the stopping position of the carriage 31 in a comparative example. In this drawing, the printer 1 is seen transparently through the top. A motor drive circuit 65 as a heat-generating part is provided so that its position in the movement direction overlaps the opening 10*a* of the casing 10 as shown in the drawing.

In this comparative example, when the motor drive circuit 65 has reached an abnormal temperature, printing is halted and the carriage 31 is stopped at a home position (the right side in the drawing). In this case, there is a risk of the user touching the high-temperature heat-radiating member 81 (particularly the portion in contact with the motor drive circuit 65, which has the highest temperature).

Present Embodiment

Figure 7:
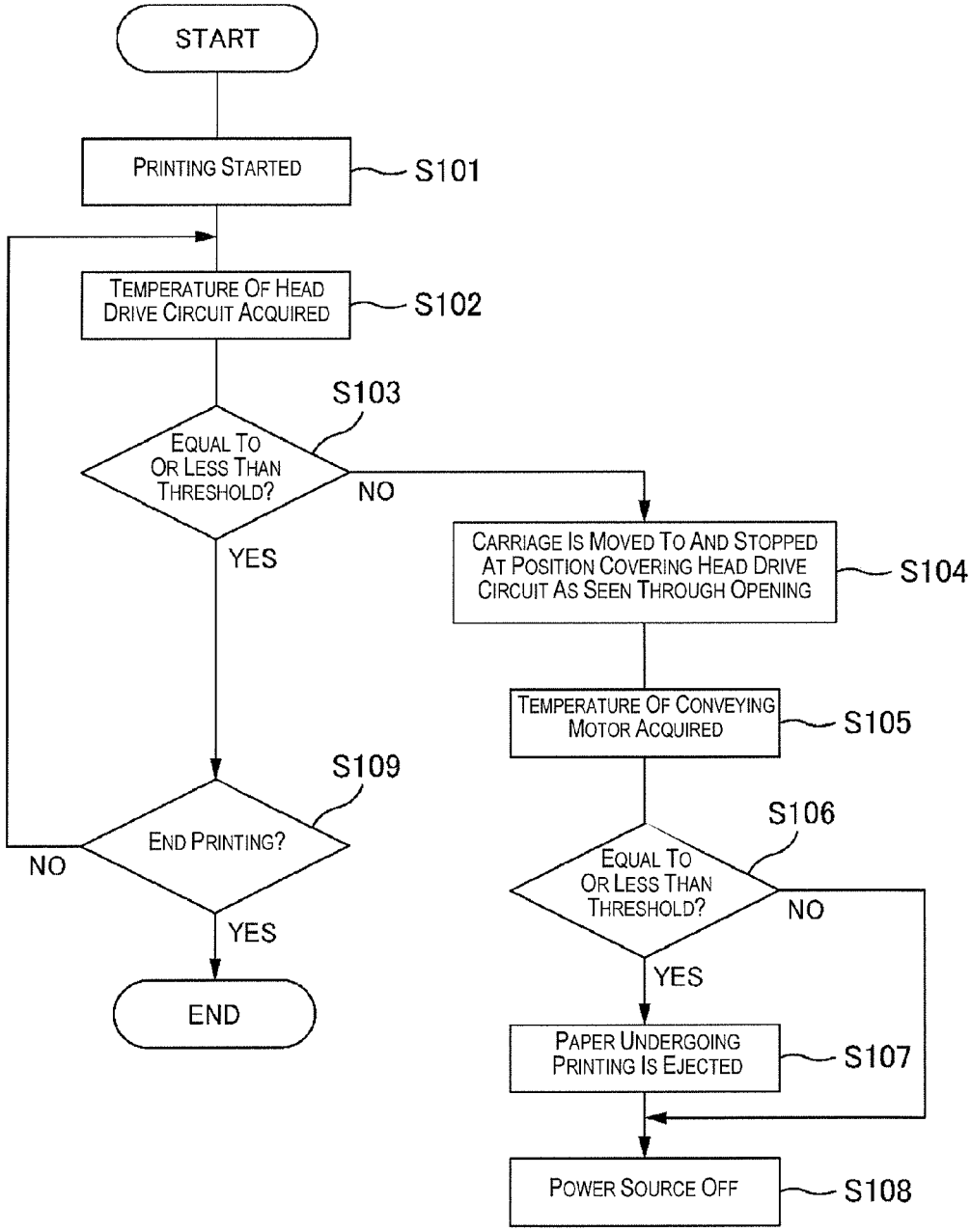
FIG. 7 is a flowchart showing the action of the device during an abnormality in the first embodiment.

FIG. 7 is a flowchart showing the action of the device during an abnormality in the first embodiment. In the present embodiment, thermistors (neither are shown) are provided respectively in proximity to the motor drive circuit 65 and in proximity to the conveying motor 22 (equivalent to the paper-feeding motor).

First, upon receiving a print command from the computer 110, the controller 60 drives the other units in order to perform the printing action previously described and starts printing on the basis of the command (S101).

During printing, the controller 60 acquires the temperature of the motor drive circuit 65 from the thermistor (not shown) provided in proximity to the motor drive circuit 65 (S102). A determination is then made as to whether or not this temperature is equal to or less than a threshold (e.g. 70 degrees) (S103).

When the temperature of the motor drive circuit 65 detected by the thermistor exceeds the threshold (NO in S103), the controller 60 moves the carriage 31 to and stops it at a position where, as seen through the opening 10*a*, it covers the motor drive circuit 65 (S104). At this time, the controller 60 moves the carriage 31 without causing ink to be ejected from the head 41. Safety can thereby be further improved because the driving of the head drive circuit 65 as a heat-generating part can be stopped promptly.

Figure 8:
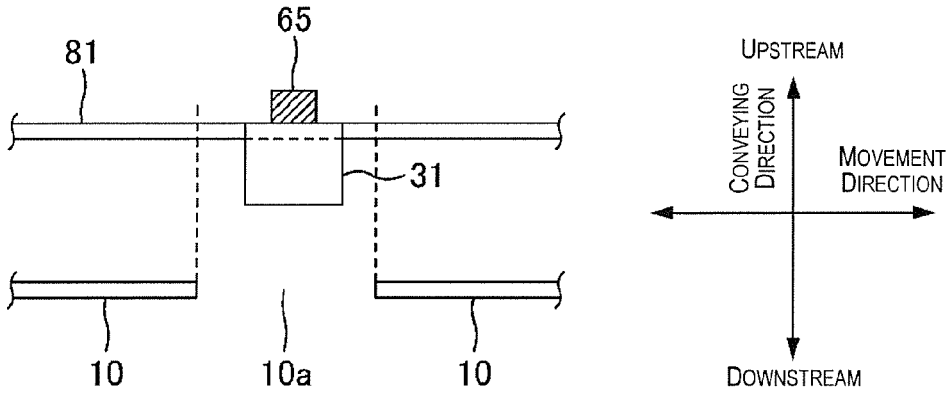
FIG. 8 is a simple explanatory drawing of the carriage stopping position in the first embodiment.

FIG. 8 is a simple explanatory drawing of the carriage stopping position in the first embodiment. Similar to FIG. 6 (the comparative example), FIG. 8 is a drawing of the printer 1 seen transparently from the top.

When the temperature of the head drive circuit 65 is abnormal, the controller 60 stops the carriage 31 at a position where it covers the motor drive circuit 65 (a heat-generating part) as seen through the opening 10*a*, as shown in FIG. 8. This makes it difficult for the user to touch the portion of the heat-radiating member 81 with the highest temperature (the portion in contact with the motor drive circuit 65) when the user puts their hand through the opening 10*a*. Consequently, safety can be improved. In the present embodiment, the carriage 31 completely covers the motor drive circuit 65, but is not limited to doing so. For example, in cases in which the motor drive circuit 65 is disposed so as to be positioned on the left side of the opening 10*a* (the left side of the drawing), the carriage can be stopped so as to cover part of the right side of the motor drive circuit 65. In this case as well, it is difficult for the user to touch the portion of the heat-radiating member 81 with the highest temperature when the user puts their hand through the opening 10*a*.

After S104 of FIG. 7, the controller 60 then acquires the temperature of the conveying motor 22 (S105) from the thermistor provided in proximity to the conveying motor 22 (the paper-feeding motor), and determines whether or not this temperature is equal to or less than a threshold (S106). When the temperature of the conveying motor 22 is equal to or less than the threshold (YES in S106), the controller 60 ejects the paper undergoing printing (S107) and turns off the power source (S108). When the temperature of the conveying motor 22 exceeds the threshold in step S106 (NO in S106), step S108 is executed in which the power source is turned off without driving the conveying motor 22 (i.e. without ejecting the paper. Safety can thereby be further improved.

In step S103, when it is determined that the temperature of the head drive circuit 65 is equal to or less than the threshold (YES in S103), the controller 60 performs a determination of whether or not to end printing (S109). When the determination is to not end printing (NO in S109), step S102 is resumed and the previously described process is executed again. When the determination is to end printing (YES in S109), the printing process is ended.

As described above, in the present embodiment, when the temperature of the heat-generating part (the motor drive circuit 65) exceeds the abnormal temperature threshold (e.g. 70 degrees), the carriage 31 is stopped at a position where it covers the motor drive circuit 65 as seen through the opening 10*a*. This makes it difficult for the user to touch the portion of the heat-radiating member 81 with the highest temperature even when the temperature of the motor drive circuit 65 is abnormal. Consequently, safety can be further improved.

In the present embodiment, the process during abnormalities of FIG. 7 (S104 to S108) was performed when the temperature of the motor drive circuit 65 exceeded the threshold, but another option is for the process during abnormalities to be executed only when the cover 11 has been opened and the temperature of the motor drive circuit 65 exceeds the threshold. This makes it possible for the process of stopping the carriage 31 at a position where it covers the motor drive circuit 65 as seen through the opening 10*a* to be limited to cases in which there is a risk of the user actually touching the heat-radiating member 81. Therefore, safety is maintained and the carriage 31 need not be moved uselessly.

Second Embodiment

In the first embodiment, when the motor drive circuit 65 reached an abnormal temperature, the carriage 31 was stopped so as to cover the motor drive circuit 65 as seen through the opening 10*a*. In the second embodiment, the position of the motor drive circuit 65 and the position where the carriage 31 is stopped are different from the first embodiment. The configuration and the processes during abnormalities are otherwise the same as the first embodiment and are therefore not described.

Figure 9:
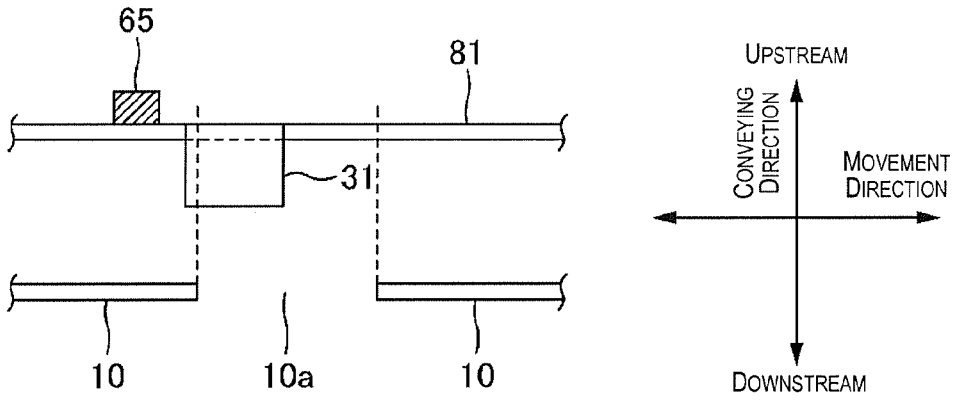
FIG. 9 is a simple explanatory drawing of the carriage stopping position in the second embodiment.

FIG. 9 is a simple explanatory drawing of the carriage stopping position in the second embodiment.

In the second embodiment, the positions of the motor drive circuit 65 and the opening 10*a* in the movement direction are misaligned as shown in the drawing. Specifically, the motor drive circuit 65 is provided so that its position in the movement direction overlaps the casing 10, which is to the left of the opening 10*a* in the drawing.

In the second embodiment, when the motor drive circuit 65 reaches an abnormal temperature (when the threshold is exceeded), the controller 60 moves the carriage 31 to and stops the carriage 31 at a position where it covers the left side of the opening 10*a* as seen through the opening 10*a*.

In this case, although the positions of the motor drive circuit 65 and the carriage 31 in the movement direction are misaligned, it is still possible to make it difficult for the user to touch the portion of the heat-radiating member 81 with the highest temperature (the portion in contact with the motor drive circuit 65) when the user puts their hand through the opening 10*a*. Consequently, safety can be improved.

In the second embodiment as well, another option is for the process during abnormalities to be executed only when the cover 11 has been opened and the temperature of the motor drive circuit 65 exceeds the threshold.

Third Embodiment

In the third embodiment, the position of the motor drive circuit 65 and the position where the carriage 31 are different from the embodiments previously described. The configuration and the processes are otherwise the same as the embodiments previously described and are therefore not described.

Figure 10:
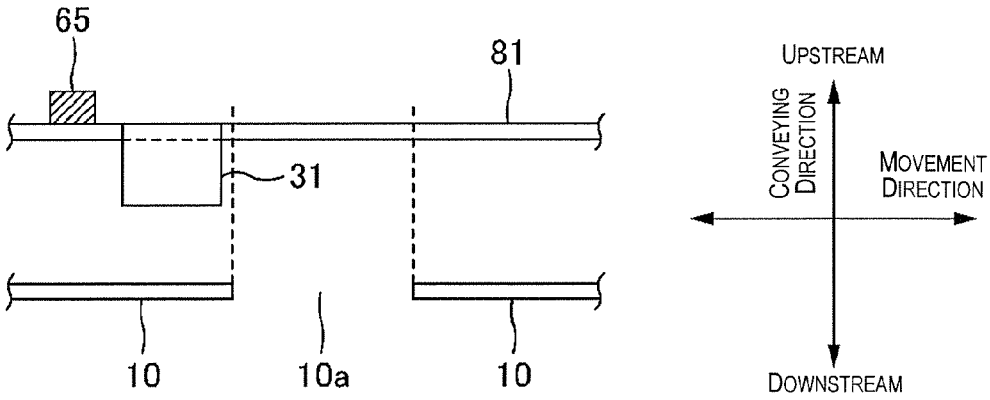
FIG. 10 is a simple explanatory drawing of the carriage stopping position in the first embodiment.

FIG. 10 is a simple explanatory drawing of the carriage stopping position in the third embodiment.

In the third embodiment, the motor drive circuit 65 is provided even further to the left (in a position distanced from the opening 10*a*) than in the second embodiment, as shown in the drawing.

In the third embodiment, when the motor drive circuit 65 reaches an abnormal temperature (when the threshold is exceeded), the controller 60 stops the carriage 31 so that at least part of the carriage 31 is positioned between the motor drive circuit 65 and the opening 10*a*. In the case of FIG. 10, the stopping position (the position in the movement direction) of the carriage 31 is between both the head drive circuit 65 and the opening 10*a*. In other words, the position of the carriage 31 in the movement direction overlaps neither the head drive circuit 65 (a heat-generating part) nor the opening 10*a*, but it is possible by stopping the carriage 31 in this position to make it difficult for the user to touch the portion of the heat-radiating member 81 with the highest temperature.

Consequently, safety can be improved in the third embodiment as well.

Other Embodiments

A printer or the like as an embodiment was described above, but the embodiments described above is intended to make the invention easier to understand and should not be interpreted as limiting the invention. The invention can be modified and improved without deviating from the scope thereof, and the invention of course includes equivalents thereof. The embodiment described hereinbelow in particular is included in the invention.

Printer

The embodiment previously described was a printer (a serial printer) which repeatedly performs a conveying action of conveying a medium in a conveying direction and a dot formation action of forming dots on a medium by ejecting ink from nozzles while moving a head in a movement direction, but the embodiment is not limited to this printer. For example, the embodiment can be a line printer including nozzle rows of a length equal to or greater than the medium width in the medium width direction, wherein ink is ejected from the nozzles of the nozzle row while the medium is conveyed in the conveying direction.

Piezo Elements

In the embodiment previously described, ink was ejected using piezo elements. However, the system for ejecting a liquid is not limited to this example. Other systems can also be used, such as a system for generating bubbles in the nozzles by heat, for example.

What is claimed is:

1. A printing device comprising:

a casing having an opening;

a carriage provided to be capable of moving within the casing in a moving direction;

a heat-generating part provided inside the casing so as to be positioned deeper in from the opening than the carriage;

a detecting part configured to detect the temperature of the interior of the casing; and a controller configured to control a movement of the carriage and determine whether detected temperature of the detecting part exceeds a predetermined value, in response to determining that the detected temperature exceeds the predetermined value, the controller controlling the carriage such that the carriage stops at a position covering at least part of the heat-generating part as seen through the opening.

2. The printing device according to claim 1, further comprising a head for discharging ink mounted on the carriage; wherein in response to determining that the detected temperature of the detecting part exceeds the predetermined value, the controller controls the carriage to move to the position without discharging ink from the head and stop the position.

3. The printing device according to claim 2, wherein the heat-generating part has a head drive transistor for driving the head and a paper-feeding motor drive transistor for driving a paper-feeding motor;

the detecting part is provided both to a proximity of the head drive transistor and a proximity of the paper-feeding motor drive transistor; and when the detected temperature of a former detecting part exceeds the predetermined value and the detected temperature of the latter detecting part has not reached the predetermined value, paper on which the head had printed is ejected and a power source is turned off.

4. The printing device according to claim 1, further comprising a cover provided to the casing so as to close off the opening; wherein when the cover is open and the detected temperature of the detecting part exceeds the predetermined value, the controller controls the carriage to stop at the position.

5. The printing device according to claim 1, wherein the casing has a first edge and a second edge opposite the first edge in the moving direction, the first edge and the second edge define partially the opening, the heat-generating part has a first side part and a second side part opposite the first side part in the moving direction, and the first side part and the second side part are positioned between the first edge and the second edge as seen through the opening.

6. The printing device according to claim 1, further comprising a guide unit configured to guide the cartridge.

7. The printing device according to claim 6, wherein the guide unit contacts the heat-generating part contact.

8. The printing device according to claim 6, wherein the guide unit is formed of a metal plate.

9. A printing device comprising:

a casing having an opening;

a carriage provided to be capable of moving within the casing in a moving direction;

a heat-generating part provided inside the casing so as to be positioned deeper in from the opening than the carriage;

a detecting part configured to detect the temperature of the interior of the casing; and a controller configured to control a movement of the carriage and determine whether detected temperature of the detecting part exceeds a predetermined value, in response to determining that the detected temperature exceeds the predetermined value, the controller controlling the carriage such that the carriage stops at a position covering at least part of the opening as seen through the opening.

10. The printing device according to claim 9, wherein the casing has a first edge and a second edge opposite the first edge in the moving direction, the first edge and the second edge define partially the opening, the heat-generating part has a first side part and a second side part opposite the first side part in the moving direction, and the heat-generating part is arranged such that the first side part is positioned closer to the first edge and the second edge than the second side part to the first edge and the second edge in the moving direction.

11. A printing device comprising:

a casing having an opening;

a carriage provided to be capable of moving within the casing in a moving direction;

a heat-generating part provided inside the casing so as to be positioned deeper in from the opening than the carriage;

a detecting part configured to detect the temperature of the interior of the casing; and a controller configured to control a movement of the carriage and determine whether detected temperature of the detecting part exceeds a predetermined value, in response to determining that the detected temperature part exceeds the predetermined value, the controller controlling the carriage such that the carriage stops so that at least part of the carriage is positioned between the heat-generating part and the opening.

12. The printing device according to claim 11, wherein the casing has a first edge and a second edge opposite the first edge in the moving direction, the first edge and the second edge define partially the opening, the heat-generating part has a first side part and a second side part opposite the first side part in the moving direction, and the heat-generating part is arranged such that the first side part is positioned closer to the first edge and the second edge than the second side part to the first edge and the second edge in the moving direction.

13. The printing device according to claim 12, wherein a distance between the first side part and the first edge in the moving direction is greater than a length of the carriage in the moving direction, and the first edge is positioned closer to the first side part than to the second edge.

* * * * *